US005082184A

United States Patent [19]

Stettner et al.

[11] Patent Number: 5,082,184

[45] Date of Patent: Jan. 21, 1992

[54] FUEL INJECTION

[75] Inventors: Ernest R. Stettner, Spencerport; Donald D. Stoltman, Henrietta, both of N.Y.

[73] Assignee: General Motors Corporation, Detroit, Mich.

[21] Appl. No.: 590,435

[22] Filed: Sep. 26, 1990

Related U.S. Application Data

[63] Continuation of Ser. No. 449,281, Dec. 5, 1989, abandoned, which is a continuation of Ser. No. 10,296, Feb. 2, 1987, abandoned, which is a continuation-in-part of Ser. No. 859,014, May 2, 1986, abandoned.

[51] Int. Cl.[5] ..... B05B 1/30; B05B 7/12

[52] U.S. Cl. ..... 239/408; 239/412; 239/585; 123/585; 137/112; 251/129.16

[58] Field of Search ..... 239/87, 407, 408, 410–413, 239/416.4, 416.5, 423, 574, 584, 585; 123/472, 585, 590; 251/129.16, 129.22; 137/112, 606

[56] References Cited

U.S. PATENT DOCUMENTS

| | | | |
|---|---|---|---|
| 2,623,786 | 12/1952 | Wille . | |
| 2,697,007 | 12/1954 | Wille | 239/410 |
| 2,881,980 | 4/1959 | Beck et al. . | |
| 2,957,682 | 10/1960 | Cameron et al. . | |
| 3,182,646 | 5/1965 | Kuechenmeister | 261/23.2 |
| 3,196,890 | 7/1965 | Brandenberg | 137/102 |
| 3,608,531 | 9/1971 | Baxendale et al. . | |
| 4,224,915 | 9/1980 | Emmenthal et al. | 123/533 |

(List continued on next page.)

FOREIGN PATENT DOCUMENTS

| | | | |
|---|---|---|---|
| 0083514 | 7/1983 | European Pat. Off. . | |
| 1243917 | 12/1967 | Fed. Rep. of Germany . | |
| 1526543 | 11/1970 | Fed. Rep. of Germany . | |
| 2900459 | 7/1980 | Fed. Rep. of Germany . | |
| 2900691 | 7/1980 | Fed. Rep. of Germany . | |
| 2920636 | 12/1980 | Fed. Rep. of Germany . | |
| 2950283 | 7/1981 | Fed. Rep. of Germany . | |
| 3028427 | 2/1982 | Fed. Rep. of Germany . | |
| 3036270 | 5/1982 | Fed. Rep. of Germany . | |
| 3047962 | 7/1982 | Fed. Rep. of Germany . | |
| 3102266 | 8/1982 | Fed. Rep. of Germany . | |
| 3123261 | 12/1982 | Fed. Rep. of Germany . | |
| 2144060 | 2/1985 | United Kingdom | 251/129.16 |
| 2163221 | 2/1986 | United Kingdom . | |
| 2163816 | 3/1986 | United Kingdom . | |
| 2175952 | 12/1986 | United Kingdom . | |
| 8500854 | 2/1985 | World Int. Prop. O. | 123/531 |
| 8600960 | 2/1986 | World Int. Prop. O. | 123/531 |

OTHER PUBLICATIONS

Automotive Engineering, vol. 94, No. 8, Aug. 1986, pp. 74–79.

SAE Technical Paper Series, #820351, "Pneumatic Fuel Metering-A New Approach to Advanced Fuel Control", McKay, 1982.

SAE Technical Paper Series, #825007, "The Orbital Fuel Metering System", McKay, 1982.

SAE Technical Paper Series, #830421, "A Fuel Injection System for Light Economy Cars", Gayler, 1983.

SAE Technical Paper Series, #850483, "Air-Forced Injection System for Spark Ignition Engines", Emmenthal et al., Mar. 1985.

*Primary Examiner*—Andres Kashnikow
*Assistant Examiner*—Karen B. Merritt
*Attorney, Agent, or Firm*—Karl F. Barr, Jr.

[57] ABSTRACT

In a fuel injection system for a multi-cylinder internal combustion engine, a plurality of injection nozzles discharge fuel adjacent the engine inlet ports, and a single injector meters the fuel to all of the injection nozzles. The injector may include an annular valve surface, a plurality of discharge passages opening through the valve surface to direct fuel to the nozzles, and a single valve member associated with the valve surface to control fuel delivery to the discharge passages. The injector may include a rectifier valve that admits air to the discharge passages when the valve member precludes fuel delivery to the discharge passages. The fuel discharge lines that connect the injector discharge passages to the nozzles may be surrounded by air lines.

11 Claims, 9 Drawing Sheets

U.S. PATENT DOCUMENTS 4,246,879 1/1981 Fiala ..... 123/533
4,307,692 12/1981 Fiala ..... 123/445
4,325,341 4/1982 Yamauchi et al. .
4,363,308 12/1982 Emmenthal et al. ..... 123/533
4,368,714 1/1983 Emmenthal et al. ..... 123/531
4,387,695 6/1983 Höppel et al. .
4,409,944 10/1983 Schmidt ..... 123/445
4,414,944 11/1983 Emmenthal et al. ..... 123/339
4,462,760 7/1984 Sarich et al. ..... 417/54
4,465,050 8/1984 Igashira et al. .
4,519,356 5/1985 Sarich ..... 123/533
4,519,370 5/1985 Iwata ..... 123/432
4,543,939 10/1985 Ehrhart et al. ..... 123/533
4,554,945 11/1985 McKay ..... 137/312
4,556,037 12/1985 Wisdom ..... 123/531
4,557,874 12/1985 Neumann et al. .
4,561,405 12/1985 Simons ..... 123/531
4,567,871 2/1986 Ma ..... 123/434
4,570,598 2/1986 Samson et al. ..... 123/445
4,572,436 2/1986 Stettner et al. ..... 239/585
4,617,898 10/1986 Gayler ..... 123/460
4,708,117 11/1987 Mesenich et al. ..... 123/533
4,754,740 7/1988 Emmenthal et al. .

Fig. 23
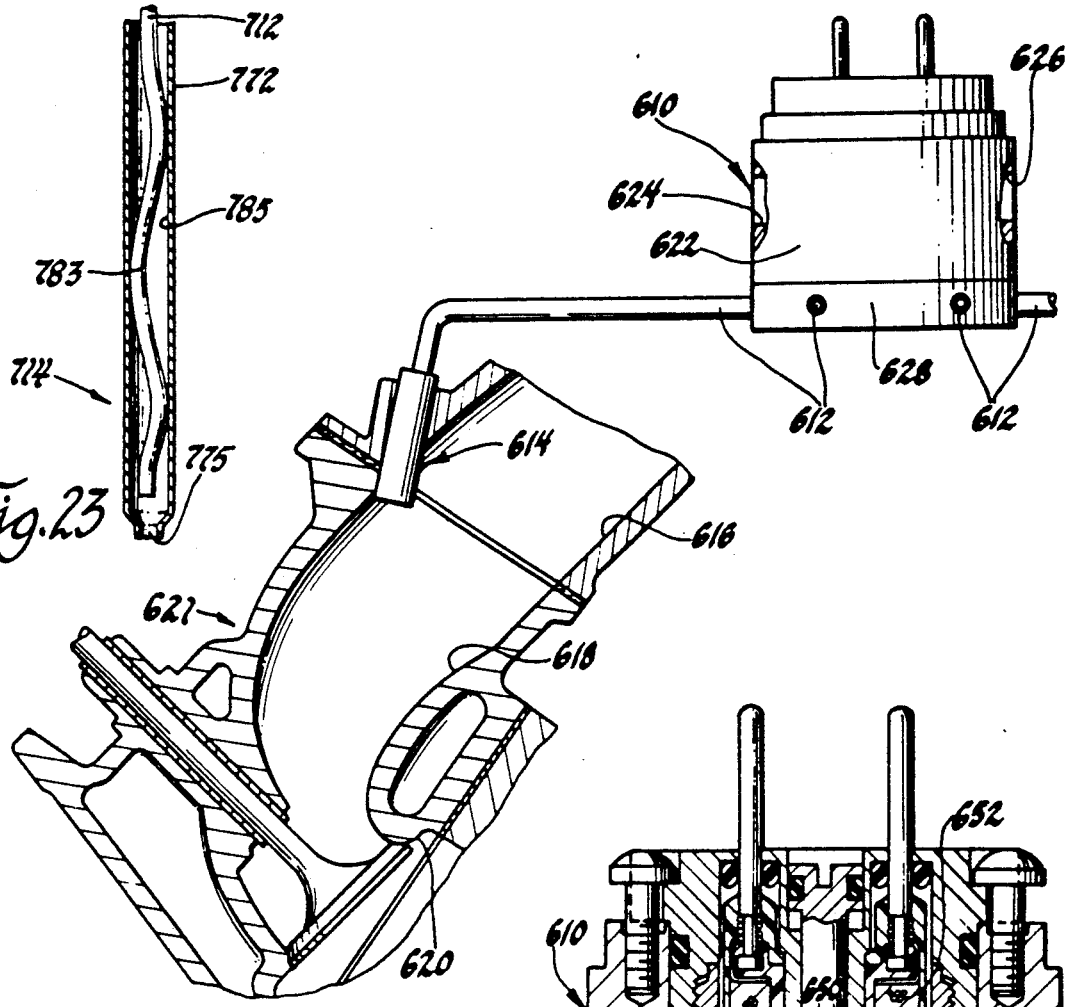
Fig. 20
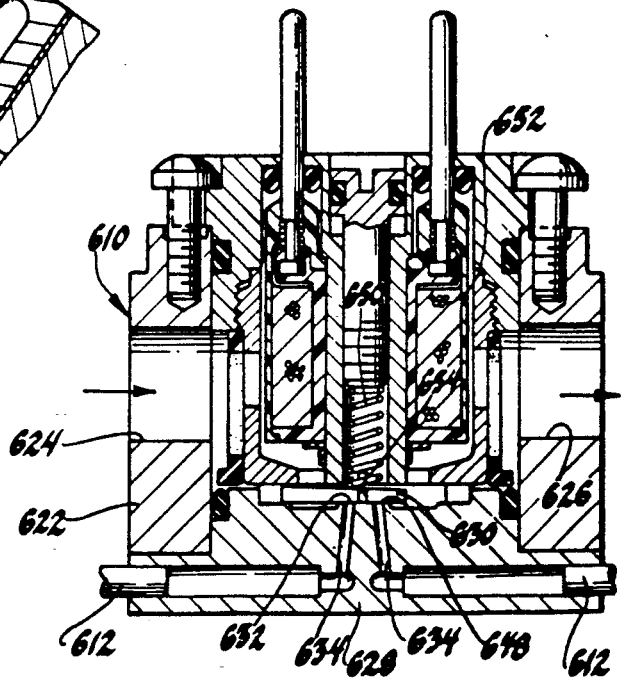
Fig. 21
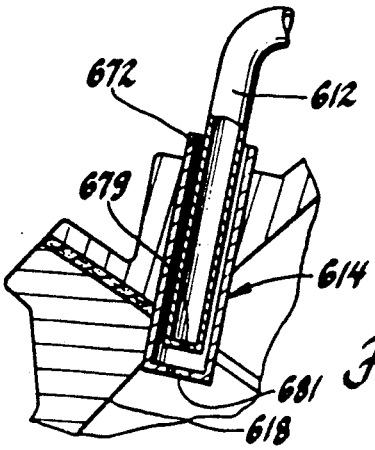
Fig. 22

FUEL INJECTION

RELATED APPLICATION

This is a continuation of application Ser. No. 07/449,281 filed Dec. 5, 1989, now abandoned, which was a continuation of application Ser. No. 07/010,296 filed Feb. 2, 1987, now abandoned, which was a continuation-in-part of application Ser. No. 06/859,014 filed May 2, 1986, now abandoned.

TECHNICAL FIELD

This invention relates to a fuel injection system for a multi-cylinder internal combustion engine in which a plurality of injection nozzles discharge fuel adjacent the engine inlet ports and a single injector meters the fuel to all of the injection nozzles.

BACKGROUND

Current automotive engine fuel injection systems employ electromagnetic injectors to meter and deliver the fuel to the engine. Throttle body fuel injection systems employ one or two injectors that deliver the fuel into the air flowing through the engine throttle body, and the mixture of air and fuel then flows through the engine inlet manifold to the inlet ports of the engine combustion chambers. Port fuel injection systems, on the other hand, typically employ individual injectors to deliver fuel directly to each of the inlet ports.

A throttle body fuel injection system with only one or two injectors has a cost advantage over a port fuel injection system with its several injectors and the associated fuel rails. However, port fuel injection systems offer advantages in engine operation. Those comparative advantages present incentive for a fuel injection system in which a single injector meters fuel and a plurality of nozzles deliver the fuel to the engine inlet ports.

SUMMARY OF THE INVENTION

This invention permits a fuel injection system to deliver fuel through a plurality of nozzles directly to the engine inlet ports and to employ a single injector to meter the fuel to all of the nozzles.

According to one feature of this invention, a single injector meters fuel through an annular region into a cylindrical chamber defined between a bore in the injector base and a plug received in the bore, and a plurality of fuel discharge passages open from the chamber to direct fuel to injection nozzles. With this feature, a solenoid operated valve in the injector may meter fuel to the discharge passages with very little motion.

According to yet another feature of this invention, a single injector meters fuel to a plurality of discharge passages that direct the fuel to injection nozzles, and a rectifier valve allows air to flow into the discharge passages when the injector is not metering fuel into the discharge passages. With this feature, the fuel maintains its discharge velocity through the discharge passages to the injection nozzles. This feature also reduces the propagation of pressure waves through the discharge passages as the injector initiates and terminates fuel flow into the discharge passages.

According to a further feature of this invention, an injector has a base with a plurality of discharge passages that receive the ends of fuel discharge lines through which fuel is directed to injection nozzles, the base has an air inlet surrounding the ends of the fuel discharge lines, and air lines surround the fuel discharge lines and direct air to the injection nozzles. With this feature, the fuel discharge lines are thermally insulated.

The details as well as other features and advantages of several embodiments of this invention are set forth in the remainder of the specification and are shown in the accompanying drawings.

SUMMARY OF THE DRAWINGS

FIG. 20 is a schematic view of yet another fuel injection system having a single injector that meters fuel to six injection nozzles in accordance with this invention.

FIG. 21 is an enlarged sectional view of the FIG. 20 injector showing a solenoid operated valve member that meters fuel directly to fuel discharge passages and lines that lead to the injection nozzles.

FIG. 22 is an enlarged sectional view of the FIG. 20 injection nozzles.

FIG. 23 is an enlarged sectional view of another tip for the FIG. 1 nozzle.

THE PREFERRED EMBODIMENTS

Figure 1:
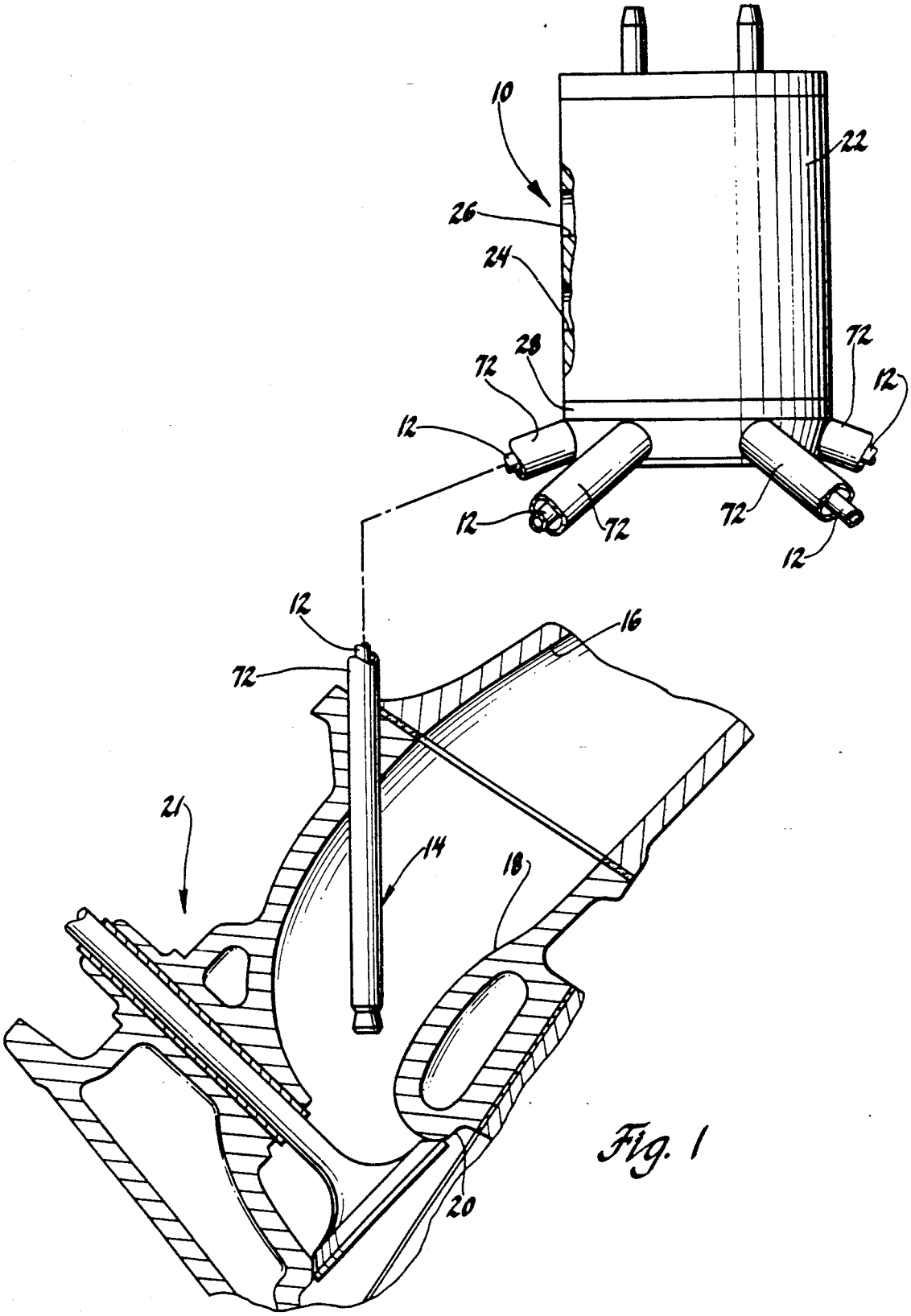
FIG. 1 is a schematic view of a fuel injection system having a single injector that meters fuel to six injection nozzles in accordance with this invention.

Referring first to the system of FIGS. 1 through 6, a single injector 10 receives fuel from a source of fuel at a desired pressure and meters fuel into six fuel discharge lines 12. Each line 12 leads to an injection nozzle 14 that delivers the metered fuel into the stream of air flowing through one of the inlet manifold runners 16 and one of the combustion chamber inlet ports 18 to one of the combustion chambers 20 of a six cylinder engine 21.

Injector 10 has a housing 22 with a fuel inlet port 24 and an excess fuel outlet port 26 that establish a path for fuel flow through housing 22. Housing 22 is secured to an injector base 28. A solenoid operated valve member 30 controls fuel flow from housing 22 through an annular region 32 of base 28 to six fuel discharge passages 34 that receive fuel discharge lines 12.

Base 28 has a central bore 36 and includes a plug 38 received in bore 36 to define a cylindrical fuel distribution chamber 40 between plug 38 and bore 36. The upper portion of plug 38 has a hexagonal configuration, the points 44 of which engage bore 36 to divide chamber 40 into six sectors 46. Each sector 46 opens into one of the fuel discharge passages 34.

The surface 48*a* surrounding bore 36 and the surface 48*b* at the perimeter of plug 38 form an annular valve surface bounding annular region 32. A spring 50 biases valve member 30 into engagement with valve surface 48*a,b* to interrupt fuel flow through annular region 32. When energized, a solenoid coil 52 lifts valve member 30 against the bias of spring 50 to permit fuel flow through annular region 32 and the sectors 46 of cylindrical fuel distribution chamber 40 to fuel discharge passages 34 and lines 12.

When valve member 30 is lifted from valve surface 48*a,b*, fuel flows through a cylindrical area between valve member 30 and valve surface 48*a*. That area is determined both by the radius of bore 36 and by the height to which valve member 30 is lifted above valve surface 48*a,b*. As the radius of bore 36 is increased, the height to which valve member 30 must be lifted may be decreased without restricting fuel flow into annular region 32. By using a central plug 38 to form the fuel flow region as an annular region 32 and to form the fuel distribution chamber as a cylindrical fuel distribution chamber 40, the radius is increased without increasing the desired area for the fuel flow region and the desired volume for the fuel distribution chamber. The use of an annular fuel flow region accordingly reduces the motion of the valve member 30 as it is lifted by solenoid coil 52.

To further reduce the motion of valve member 30 as it is lifted by solenoid coil 52, valve member 30 has an aperture 54 opening from housing 22 to a space 56 beneath valve member 30 within valve surface 48*b*. Thus when valve member 30 is lifted by coil 52, fuel flows into annular region 32 both around valve member 30 and through aperture 54 and space 56. It will be understood, therefore, that the clearance required between valve member 30 and valve surface 48*a* is less with aperture 54 providing a path for fuel flow between valve member 30 and valve surface 48*b* into annular region 32 than would be required if it were necessary for all fuel flow into annular region 32 to pass around valve member 30 and between valve member 30 and valve surface 48*a*.

Injector 10 is controlled to meter fuel in a conventional manner by energizing solenoid coil 52 with a pulse width modulated current. As the pulse width is increased, valve member 30 is lifted for an increased length of time to increase the duration of fuel flow into discharge lines 12.

Plug 38 has a recess 58 open to the atmosphere and six ports 60 opening slightly downwardly from recess 58 into the sectors 46 of fuel distribution chamber 40. A hollow valve seat member 62 is received in recess 58 and has an upwardly facing valve seat 64. A lightweight Mylar rectifier valve disc 66 rests on valve seat 64.

Base 28 has a larger recess 68 open to the atmosphere and six air passages 70 surrounding fuel discharge lines 12. Air passages 70 receive air lines 72 that are disposed concentrically about fuel discharge lines 12.

Further details of the construction of injector 10 are set forth in U.S. Pat. No. 4,572,436 issued Feb. 25, 1986 in the names of K. P. Cianfichi, E. R. Stettner and D. D. Stoltman and will not be repeated here.

Fuel discharge lines 12 and air lines 72 terminate in injection nozzles 14. Each nozzle 14 has a fluted insert 74 with a tapered tip 76 engaged in the end of fuel discharge line 12 and a tapered base 78 engaged in the end of air line 72. Insert 74 aligns fuel discharge line 12 within air line 72, and its flutes 80 deliver the fuel and air into the stream of air flowing through the inlet manifold runner 16.

In operation, the atmospheric pressure in recess 68 induces air to flow through air lines 72 to the subatmospheric pressure in the inlet ports 18, and the atmospheric pressure in recess 58 induces air to flow past rectifier valve disc 66 and through ports 60, sectors 46 of fuel distribution chamber 40, and fuel discharge passages 34 and lines 12 to the subatmospheric pressure in inlet ports 18. When solenoid coil 52 lifts valve member 30 and fuel flows through annular region 32 into the sectors 46 of fuel distribution chamber 40, the increased pressure in fuel distribution chamber 40 stops air flow through ports 60 from recess 58 and engages valve disc 66 with its seat 64. When solenoid coil 52 is deenergized and spring 50 engages valve member 30 against valve surface 48*a,b*, air will again be induced to flow from recess 58 past rectifier valve disc 66 and through ports 60, sectors 46 of fuel distribution chamber 40, and fuel discharge passages 34 and lines 12.

Air flow through the sectors 46 of fuel distribution chamber 40 and the fuel discharge passages 34 and lines 12 allows the inertia of the fuel to maintain its discharge velocity, and reduces propagation of pressure waves through fuel discharge lines 12 as valve member 30 is lifted from and engaged with valve surface 48*a,b*. Such air flow also provides a source of air at substantially atmospheric pressure immediately below valve member 30, thereby providing an essentially constant pressure in the annular region 32 to which valve member 30 delivers fuel.

Fuel discharge passages 34 open from the bottom of fuel distribution chamber sectors 46, while ports 60 open slightly downwardly into the upper portion of sectors 46. With this construction, it is thought that fuel flow through sectors 46 past ports 60 will create a suction tending to assist in quickly lifting rectifier valve disc 66 from its seat 64.

Air flow through air lines 72 thermally insulates fuel lines 12, and provides a source of air at substantially atmospheric pressure at the tip of nozzles 14 where the fuel is introduced into the stream of air flowing through the inlet ports 18.

In the particular application for which this embodiment of the invention was developed, nozzle 14 is proportioned so that the vacuum in the zone 82 within air line 72 at the end of fuel discharge line 12 is about 10% of the vacuum in the intake port 18 at the end of nozzle 14 (that is, the difference between the pressure in zone 82 and the atmospheric pressure is about 10% of the difference between the pressure in intake port 18 and the atmospheric pressure). In that same application, fuel discharge line 12 is formed of tubing with a 0.034 in (0.864 mm) inside diameter and a 0.063 in (1.60 mm) outside diameter, and air line 72 is formed of tubing with a 0.093 in (2.36 mm) inside diameter and a 0.118 in (3.00 mm) outside diameter. Other parts are sized accordingly.

Figure 7:
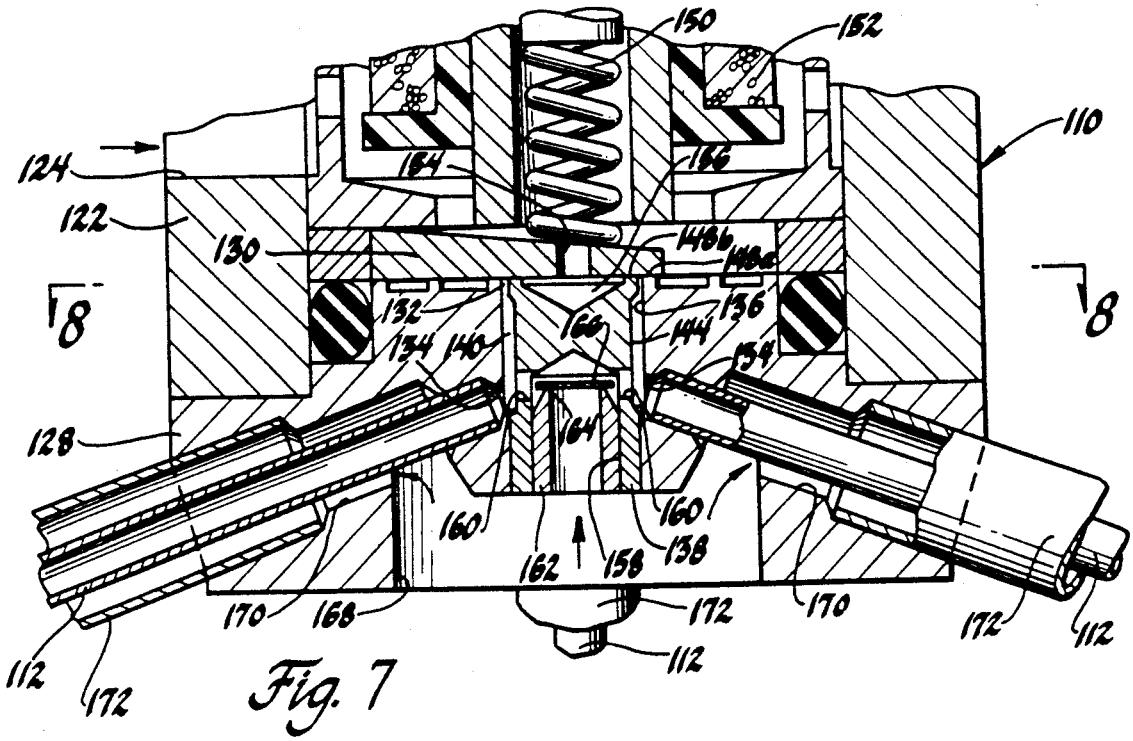
FIG. 7 is an enlarged sectional view of an injector for a system similar to the FIG. 1 system but in which the injector meters fuel to four injection nozzles in accordance with this invention; in this injector a solenoid operated valve member meters fuel through a cylindrical fuel distribution chamber to fuel discharge passages and lines that lead to the injection nozzles, a rectifier valve disc admits air through the fuel distribution chamber to the fuel discharge passages and lines, and an air inlet is provided for air lines that surround the fuel discharge lines.
Figure 8:
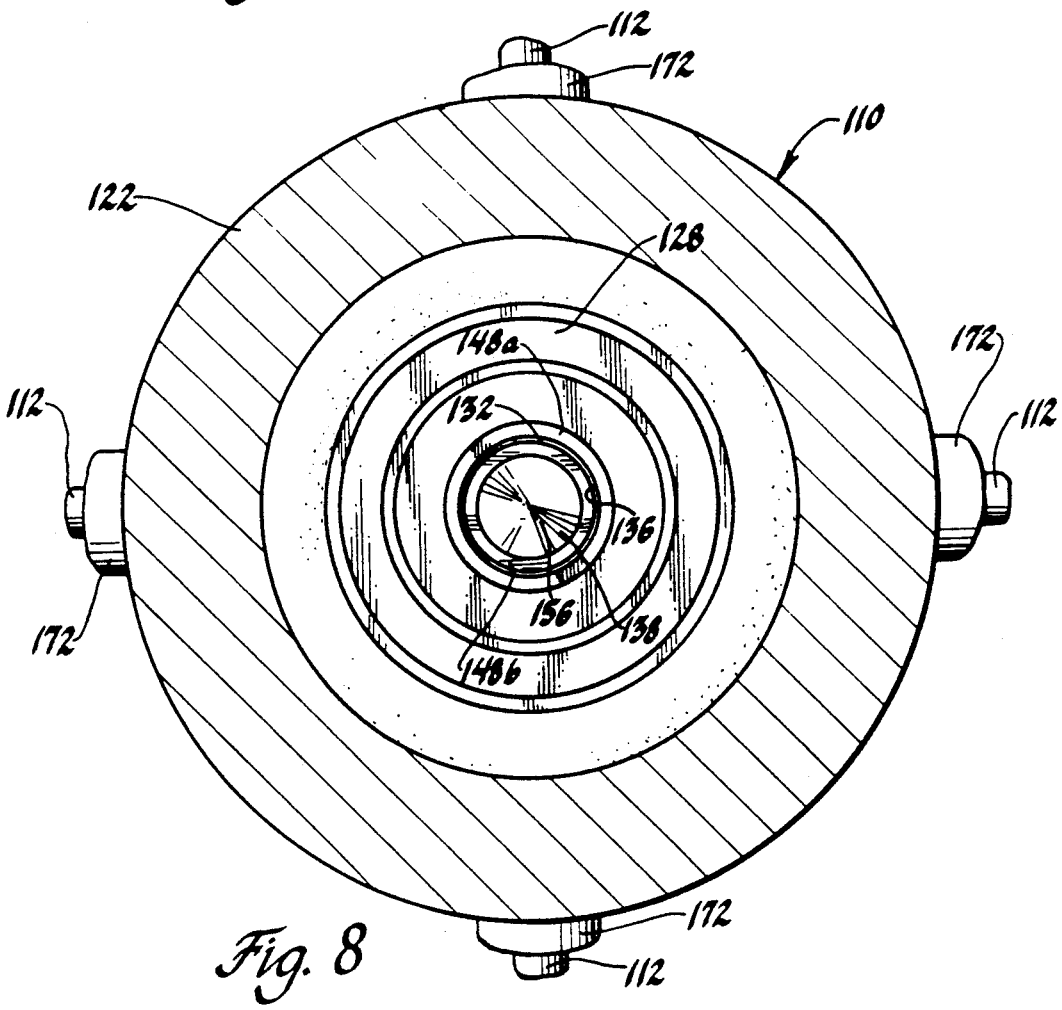
FIG. 8 is a view, indicated by the line 8—8 of FIG. 7, of the fuel inlet side of the base of the FIG. 7 injector.

Referring next to the injector of FIGS. 7 and 8, a single injector 110 receives fuel from a source of fuel at a desired pressure and meters fuel into four fuel discharge lines 112. Each line 112 leads to an injection nozzle that delivers the metered fuel into the stream of air flowing through one of the inlet manifold runners and one of the combustion chamber inlet ports to one of the combustion chambers of a four cylinder engine.

Injector 110 has a housing 122 with a fuel inlet port 124 and an excess fuel outlet port that establish a path for fuel flow through housing 122. Housing 122 is secured to an injector base 128. A solenoid operated valve member 130 controls fuel flow from housing 122 through an annular region 132 of base 128 to four fuel discharge passages 134 that receive fuel discharge lines 112.

Base 128 has a central bore 136 and includes a plug 138 received in bore 136 to define a cylindrical fuel distribution chamber 140 between plug 138 and bore 136. The upper portion of plug 138 differs from the upper portion of plug 38 shown in FIGS. 2 and 3; plug 138 has a circular configuration, the circumference 144 of which is uniformly spaced from bore 136. Chamber 140 opens into the fuel discharge passages 134.

The surface 148*a* surrounding bore 136 and the surface 148*b* at the perimeter of plug 138 form an annular valve surface bounding annular region 132. A spring 150 biases valve member 130 into engagement with valve surface 148*a,b* to interrupt fuel flow through annular region 132. When energized, a solenoid coil 152 lifts valve member 130 against the bias of spring 150 to permit fuel flow through annular region 132 and fuel distribution chamber 140 to fuel discharge passages 134 and lines 112.

When valve member 130 is lifted from valve surface 148*a,b*, fuel flows through a cylindrical area between valve member 130 and valve surface 148*a*. That area is determined both by the radius of bore 136 and by the height to which valve member 130 is lifted above valve surface 148*a,b*. As the radius of bore 136 is increased, the height to which valve member 130 must be lifted may be decreased without restricting fuel flow into annular region 132. By using a central plug 138 to form the fuel flow region as an annular region 132 and to form the fuel distribution chamber as a cylindrical fuel distribution chamber 140, the radius is increased without increasing the desired area for the fuel flow region and the desired volume for the fuel distribution chamber. The use of an annular fuel flow region accordingly reduces the motion of the valve member 130 as it is lifted by solenoid coil 152.

To further reduce the motion of valve member 130 as it is lifted by solenoid coil 152, valve member 130 has an aperture 154 opening from housing 122 to a space 156 beneath valve member 130 within valve surface 148*b*. Thus when valve member 130 is lifted by coil 152, fuel flows into annular region 132 both around valve member 130 and through aperture 154 and space 156. It will be understood, therefore, that the clearance required between valve member 130 and valve surface 148*a* is less with aperture 154 providing a path for fuel flow between valve member 130 and valve surface 148*b* into annular region 132 than would be required if it were necessary for all fuel flow into annular region 132 to pass around valve member 130 and between valve member 130 and valve surface 148*a*.

Plug 138 has a recess 158 open to the atmosphere and four ports 160 opening horizontally from recess 158 into fuel distribution chamber 140 opposite fuel discharge passages 134. A hollow valve seat member 162 is received in recess 158 and has an upwardly facing valve seat 164. A lightweight Mylar rectifier valve disc 166 rests on valve seat 164.

Base 128 has a larger recess 168 open to the atmosphere and four air passages 170 surrounding fuel discharge lines 112. Air passages 170 receive air lines 172 that are disposed concentrically about fuel discharge lines 112.

Injector 110 is in other respects similar to injector 10, and further details of construction are set forth in U.S. Pat. No. 4,572,436 and will not be repeated here.

In operation, the atmospheric pressure in recess 168 induces air to flow through air lines 172 to the subatmospheric pressure in the engine inlet ports, and the atmospheric pressure in recess 158 induces air to flow past rectifier valve disc 166 and through ports 160, across fuel distribution chamber 140, and through fuel discharge passages 134 and lines 112 to the subatmospheric pressure in the inlet ports. When solenoid coil 152 lifts valve member 130 and fuel flows through annular region 132 into fuel distribution chamber 140, the increased pressure in fuel distribution chamber 140 stops air flow through ports 160 from recess 158 and engages rectifier valve disc 166 with its seat 164. When solenoid coil 152 is deenergized and spring 150 engages valve member 130 against valve surface 148*a,b*, air will again be induced to flow from recess 158 past rectifier valve disc 166 and through ports 160, fuel distribution chamber 140, and fuel discharge passages 134 and lines 112.

Air flow through fuel distribution chamber 140 and the fuel discharge passages 134 and lines 112 allows the inertia of the fuel to maintain its discharge velocity, and reduces propagation of pressure waves through fuel discharge lines 112 as valve member 130 is lifted from and engaged with valve surface 148*a,b*. Such air flow also provides a source of air at substantially atmospheric pressure immediately below valve member 130, thereby providing an essentially constant pressure in the annular region 132 to which valve member 130 delivers fuel.

Air flow through air lines 172 thermally insulates fuel lines 112, and provides a source of air at substantially atmospheric pressure at the tip of the nozzles where the fuel is introduced into the stream of air flowing through the inlet ports.

Figure 9:
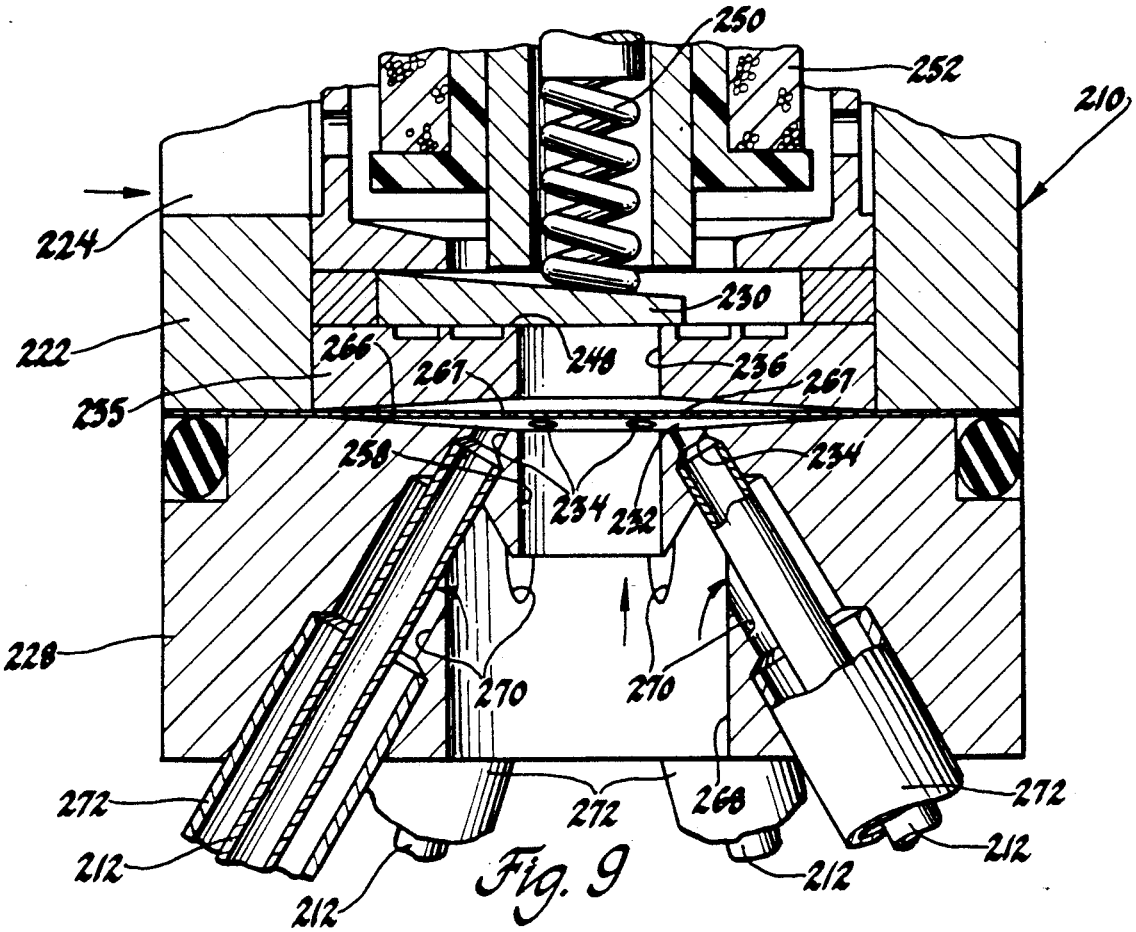
FIG. 9 is an enlarged sectional view of another injector for a system similar to FIG. 1; in this injector a solenoid operated valve member meters fuel through an open fuel chamber to fuel discharge passages and lines that lead to the injection nozzles, a diaphragm valve admits air to the fuel discharge passages and lines, and an air inlet is provided for air lines that surround the fuel discharge lines.
Figure 10:
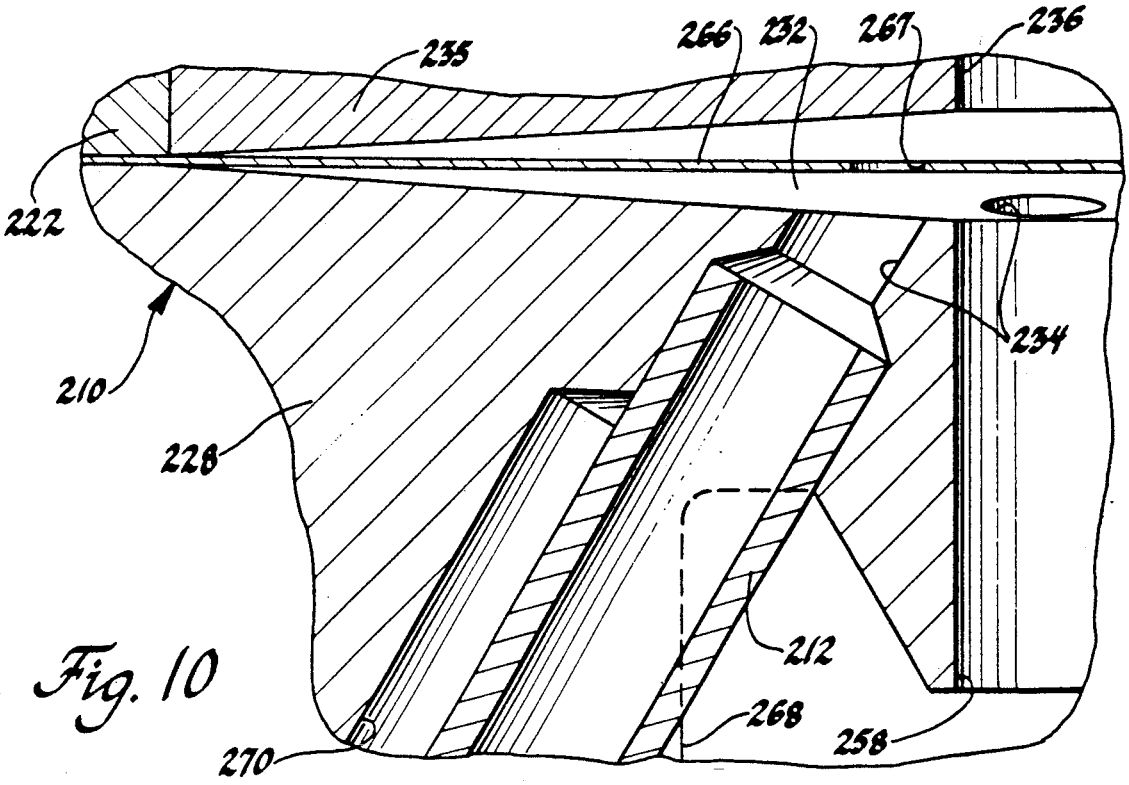
FIG. 10 is a further enlarged view of a portion of the FIG. 9 injector, showing the diaphragm valve and its environment.

Referring now to the injector of FIGS. 9 and 10, a single injector 210 receives fuel from a source of fuel at a desired pressure and meters fuel into six fuel discharge lines 212. Each line 212 leads to an injection nozzle that delivers the metered fuel into the stream of air flowing through one of the inlet manifold runners and one of the combustion chamber inlet ports to one of the combustion chambers of a six cylinder engine.

Injector 210 has a housing 222 with a fuel inlet port 224 and an excess fuel outlet port that establish a path for fuel flow through housing 222. Housing 222 is secured to an injector base 228. A solenoid operated valve member 230 controls fuel flow from housing 222 through an annular region 232 of base 228 to six fuel discharge passages 234 that receive fuel discharge lines 212.

Base 228 includes a plate 235 that has a central bore 236 leading to annular region 232. Annular region 232 opens directly into the fuel discharge passages 234.

The surface 248 surrounding bore 236 forms an annular valve surface. A spring 20 biases valve member 230 into engagement with valve surface 248 to interrupt fuel flow through annular region 232. When energized, a solenoid coil 252 lifts valve member 230 against the bias of spring 250 to permit fuel flow through annular region 232 to fuel discharge passages 234 and lines 212.

Base 228 has another bore 258 opening from the atmosphere into annular region 232. A diaphragm 266 is sandwiched between the main portion of base 228 and its plate 235, overlying annular region 232 and separating the fuel bore 236 from the air bore 258. Diaphragm has six apertures 267 aligned with fuel discharge passages 234.

Base 228 has a larger recess 268 open to the atmosphere and six air passages 270 surrounding fuel discharge lines 212. Air passages 270 receive air lines 272 that are disposed concentrically about fuel discharge lines 212.

Injector 210 is in other respects similar to injector 10, and further details of construction are set forth in U.S. Pat. No. 4,572,436 and will not be repeated here.

In operation, the atmospheric pressure in recess 268 induces air to flow through air lines 272 to the subatmospheric pressure in the inlet ports, and the atmospheric pressure in bore 258 induces air to flow beneath diaphragm 266 and through fuel discharge passages 234 and lines 212 to the subatmospheric pressure in the inlet ports. When solenoid coil 252 lifts valve member 230 and fuel flows through bore 236, the increased pressure in bore 236 engages diaphragm 266 with annular region 232, thereby obstructing air flow from bore 258 to fuel discharge passages 234 and lines 212. When solenoid coil 252 is deenergized and spring 250 engages valve member 230 against valve surface 248, air will again be induced to lift diaphragm 266 from annular region 232 and flow from bore 258 through fuel discharge passages 234 and lines 212.

Air flow through fuel discharge passages 234 and lines 212 allows the inertia of the fuel to maintain its discharge velocity, and reduces propagation of pressure waves through fuel discharge lines 212 as valve member 230 is lifted from and engaged with valve surface 248. Such air flow also provides a source of air at substantially atmospheric pressure immediately below valve member 230, thereby providing an essentially constant pressure in the annular region 232 to which valve member 230 delivers fuel.

Air flow through air lines 272 thermally insulates fuel lines 212, and provides a source of air at substantially atmospheric pressure at the tip of the nozzles where the fuel is introduced into the stream of air flowing through the engine inlet ports.

Figure 11:
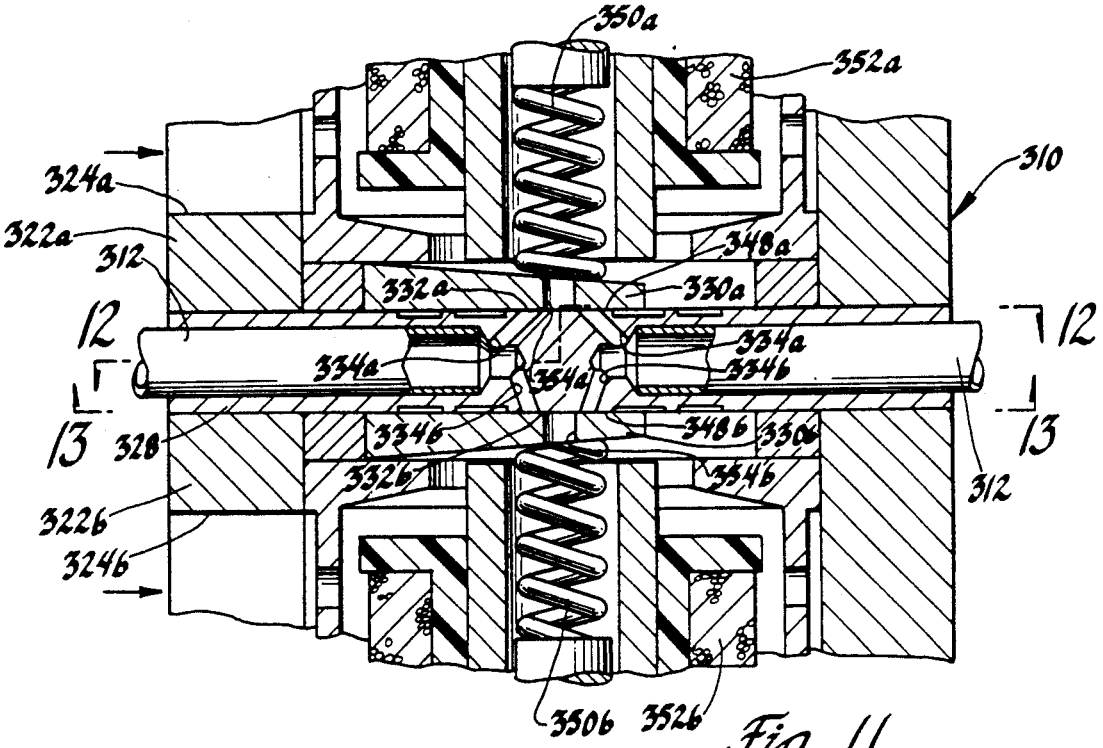
FIG. 11 is an enlarged sectional view of another injector that meters fuel to six injection nozzles in accordance with this invention; in this injector a pair of solenoid operated valve members meter fuel and air directly to fuel discharge passages and lines that lead to the injection nozzles.
Figure 12:
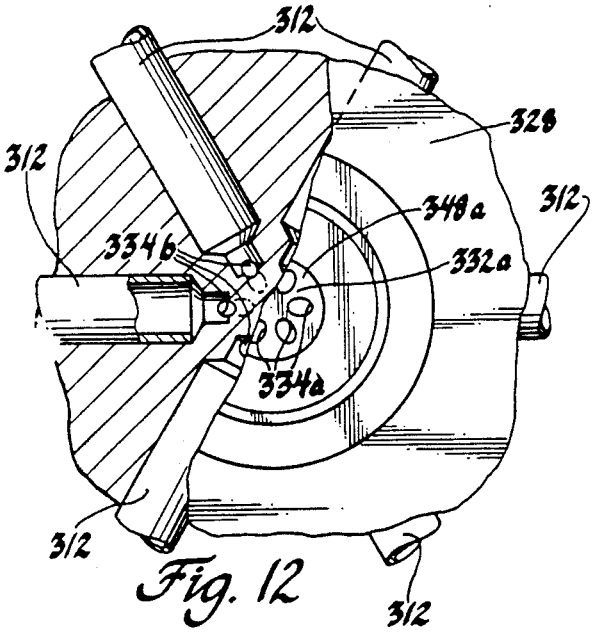
FIG. 12 is a view indicated by the line 12—12 of FIG. 11, showing the fuel inlet side of the base of the FIG. 11 injector.
Figure 13:
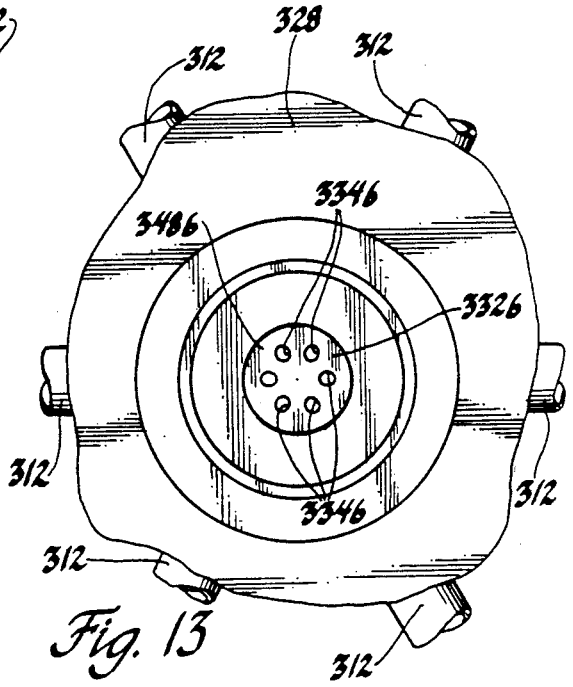
FIG. 13 is a view, indicated by the line 13—13 of FIG. 11, showing the air inlet side of the base of the FIG. 11 injector.
Figure 14:
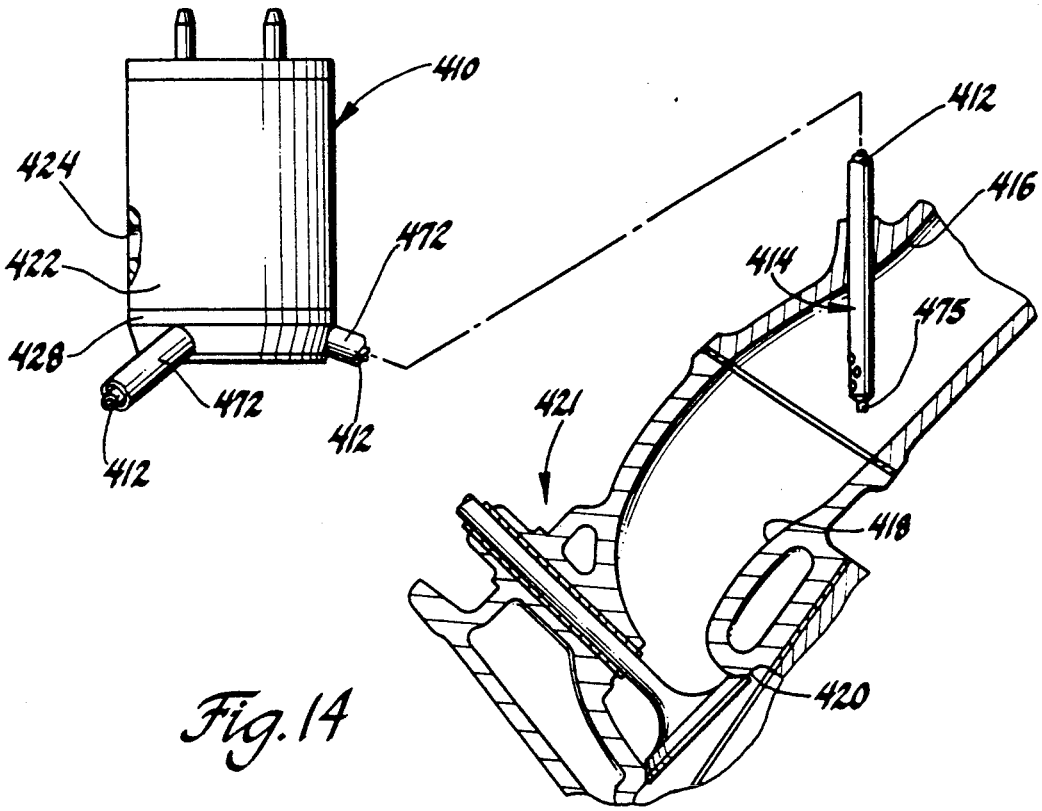
FIG. 14 is a schematic view of another fuel injection system having a single injector that meters fuel to three injection nozzles in accordance with this invention.
Figure 15:
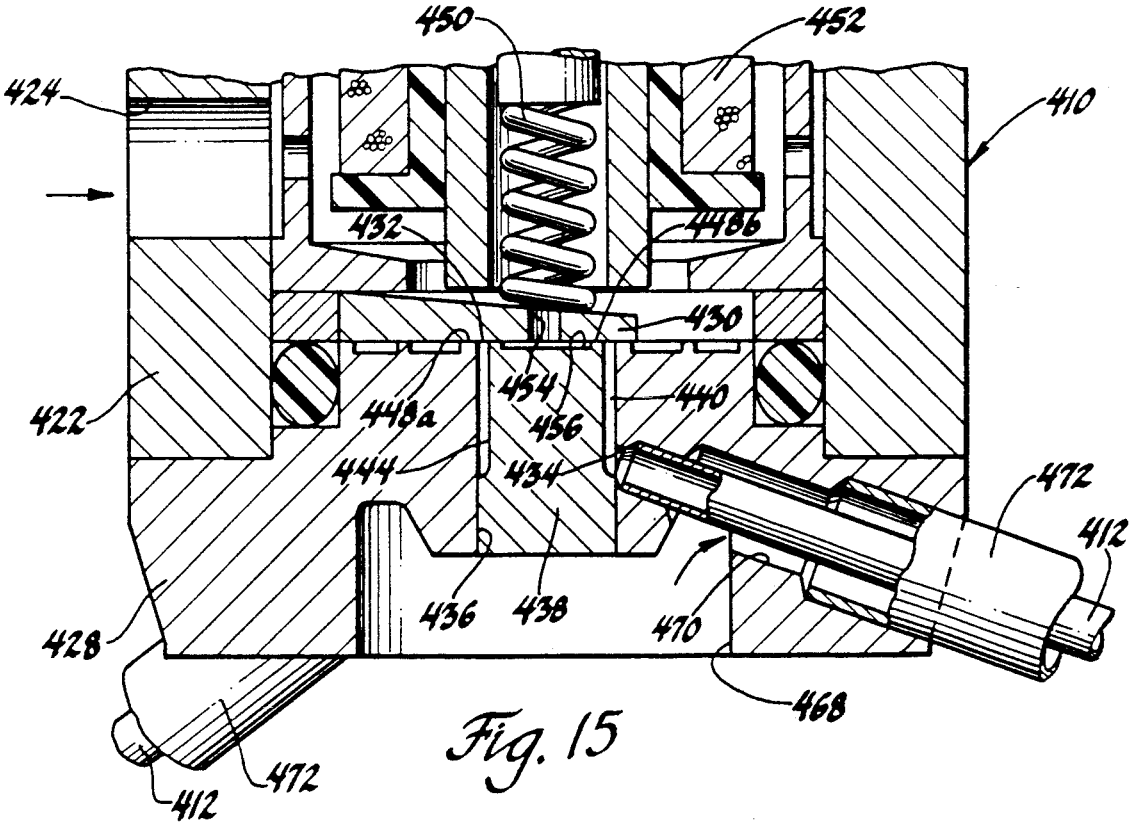
FIG. 15 is an enlarged sectional view of the FIG. 14 injector, showing a solenoid operated valve member that meters fuel through a cylindrical fuel distribution chamber to fuel discharge passages and lines that lead to the injection nozzles, and an air inlet for air lines that surround the fuel discharge lines.
Figure 16:
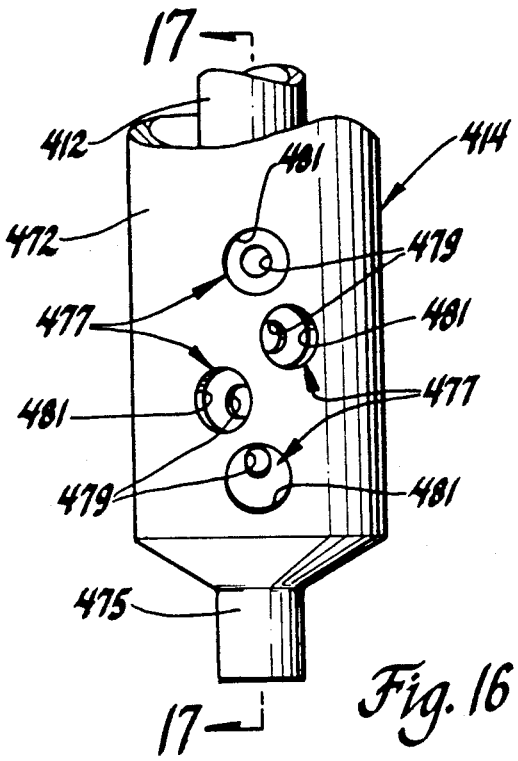
FIG. 16 is an enlarged view of the tip of the FIG. 14 injection nozzles.
Figure 17:
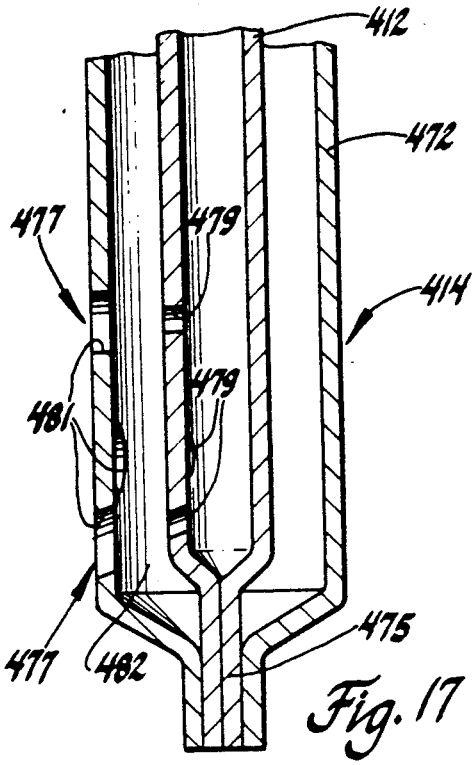
FIG. 17 is a sectional view of the FIG. 16 tip, taken along line 17—17 of FIG. 16.

Referring to the injector of FIGS. 11 through 13, a single injector 310 receives fuel from a source of fuel at a desired pressure and meters fuel into six fuel discharge lines 312. Each line 312 leads to an injection nozzle that delivers the metered fuel into the stream of air flowing through one of the inlet manifold runners and one of the combustion chamber inlet ports to one of the combustion chambers of a six cylinder engine.

Injector 310 has a housing 322*a* with a fuel inlet port 324*a* and an excess fuel outlet port that establish a path for fuel flow through housing 322*a*. Housing 322*a* is secured to an injector base 328. A solenoid operated valve member 330*a* controls fuel flow from housing 322*a* through an annular region 332*a* of base 328 to six fuel discharge passages 334*a* that extend to fuel discharge lines 312.

Annular region 332*a* includes a valve surface 348*a*. A spring 350*a* biases valve member 330*a* into engagement with valve surface 348*a* to interrupt fuel flow through annular region 332*a*. When energized, a solenoid coil 352*a* lifts or retracts valve member 330*a* against the bias of spring 350*a* to permit fuel flow through annular region 332*a* to fuel discharge passages 334*a* and lines 312.

Injector 310 also has a housing 322*b* with an air inlet port 324*b*. Housing 322*b* is secured to base 328. A solenoid operated valve member 330*b* controls air flow from housing 322*b* through an annular region 332*b* of base 328 to six air discharge passages 334*b* that extend to fuel discharge lines 312.

Annular region 332*b* includes a valve surface 348*b*. A spring 350*b* biases valve member 330*b* into engagement with valve surface 348*b* to interrupt air flow through annular region 332*b*. When energized, a solenoid coil 352*b* retracts valve member 330*b* against the bias of spring 350*b* to permit air flow through annular region 332*b* to air discharge passages 334*b* and lines 312.

To reduce the motion of valve members 330*a,b* as they are retracted by solenoid coils 352*a,b* valve members 330*a,b* have apertures 354*a,b* opening from housings 322*a,b* to the center of annular regions 332*a,b*. Thus when valve members 330*a,b* are retracted by coils 352*a,b*, fuel and air flow into annular regions 332*a,b* both around valve members 330*a,b* and through apertures 354*a,b*. It will be understood, therefore, that the clearance required between valve members 330*a,b* and valve surfaces 348*a,b* is less with apertures 354*a,b* providing paths for fuel and air flow between valve members 330*a,b* and valve surfaces 348*a,b* into annular regions 332*a,b* than would be required if it were necessary for all fuel and air flow into annular regions 332*a,b* to pass around valve members 330*a,b*.

Injector 310 is in other respects similar to injector 10, and further details of construction are set forth in U.S. Pat. No. 4,572,436 and will not be repeated here.

In operation, solenoid coils 352*a,b* are energized alternately. When coil 352*b* is energized, the pressure in housing 322*b* induces air to flow through air discharge passages 334*b* and fuel discharge lines 312 to the subatmospheric pressure in the engine inlet ports. When solenoid coil 352*a* is energized, fuel flows through annular region 332*a* to fuel discharge passages 334*a* and lines 312.

Air flow through the fuel discharge lines 312 allows the inertia of the fuel to maintain its discharge velocity, and reduces propagation of pressure waves through fuel discharge lines 312 as valve member 330*a* is lifted from and engaged with valve surface 348*a*.

Such air flow also creates an essentially constant pressure in the annular region 332*a* to which valve member 330*a* delivers fuel.

Referring to the system of FIGS. 14 through 17, a single injector 410 receives fuel from a source of fuel at a desired pressure and meters fuel into three fuel discharge lines 412. Each line 412 leads to an injection nozzle 414 that delivers the metered fuel into the stream of air flowing through one of the inlet manifold runners 416 and one of the combustion chamber inlet ports 418 to one of the combustion chambers 420 of a three cylinder engine 421.

Injector 410 has a housing 422 with a fuel inlet port 424 and an excess fuel outlet port that establish a path for fuel flow through housing 422. Housing 422 is secured to an injector base 428. A solenoid operated valve member 430 controls fuel flow from housing 422 through an annular region 432 of base 428 to three fuel discharge passages 434 that receive fuel discharge lines 412.

Base 428 has a central bore 436 and includes a plug 438 received in bore 436 to define a cylindrical fuel distribution chamber 440 between plug 438 and bore 436. The upper portion of plug 438 has a cylindrical configuration, the circumference 444 of which is evenly spaced from bore 436. Fuel distribution chamber 440 opens into the fuel discharge passages 434.

The surface 448*a* surrounding bore 436 and the surface 448*b* at the perimeter of plug 438 form an annular valve surface bounding annular region 432. A spring 450 biases valve member 430 into engagement with valve surface 448*a,b* to interrupt fuel flow through annular region 432. When energized, a solenoid coil 452 lifts valve member 430 against the bias of spring 450 to permit fuel flow through annular region 432 and fuel distribution chamber 440 to fuel discharge passages 434 and lines 412.

When valve member 430 is lifted from valve surface 448*a,b*, fuel flows through a cylindrical area between valve member 430 and valve surface 448*a*. That area is determined both by the radius of bore 436 and by the height to which valve member 430 is lifted above valve surface 448*a,b*. As the radius of bore 436 is increased, the height to which valve member 430 must be lifted may be decreased without restricting fuel flow into annular region 432. By using a central plug 438 to form the fuel flow region as an annular region 432 and to form the fuel distribution chamber as a cylindrical fuel distribution chamber 440, the radius is increased without increasing the desired area for the fuel flow region and the desired volume for the fuel distribution chamber. The use of an annular fuel flow region accordingly reduces the motion of the valve member 430 as it is lifted by solenoid coil 452.

To further reduce the motion of valve member 430 as it is lifted by solenoid coil 452, valve member 430 has an aperture 454 opening from housing 422 to a space 456 beneath valve member 430 within valve surface 448*b*. Thus when valve member 430 is lifted by coil 452, fuel flows into annular region 432 both around valve member 430 and through aperture 454 and space 456. It will be understood, therefore, that the clearance required between valve member 430 and valve surface 448*a* is less with aperture 454 providing a path for fuel flow between valve member 430 and valve surface 448*b* into annular region 432 than would be required if it were necessary for all fuel flow into annular region 432 to pass around valve member 430 and between valve member 430 and valve surface 448*a*.

Base 428 has a recess 468 open to the atmosphere and three air passages 470 surrounding fuel discharge lines 412. Air passages 470 receive air lines 472 that are disposed concentrically about fuel discharge lines 412.

Injector 410 is in other respects similar to injector 10, and further details of construction are set forth in U.S. Pat. No. 4,572,436 and will not be repeated here.

Fuel discharge lines 412 and air lines 472 terminate in injection nozzles 414. The end 475 of each nozzle 414 is closed, and each nozzle has four lateral apertures 477 to deliver the fuel and air into the stream of air flowing through the inlet manifold runner 416. Each aperture 477 includes a small aperture 479 opening from fuel discharge line 412 into air line 472 and a larger aperture 481 opening from air line 472.

In operation, the atmospheric pressure in recess 468 induces air to flow through air lines 472 to the subatmospheric pressure in the inlet manifold runners 416. When solenoid coil 452 lifts valve member 430, fuel flows through annular region 432, fuel distribution chamber 440, and fuel discharge passages 434 and lines 412 and is injected through the zone 482 within air line 472 at the end of fuel discharge line 412.

Air flow through air lines 472 thermally insulates fuel lines 412, and provides a source of air at substantially atmospheric pressure at the tip of nozzles 414 where the fuel is introduced into the stream of air flowing through the inlet manifold runner 416.

In the particular application for which this embodiment of the invention was developed, fuel discharge line 412 is formed of tubing with a 0.034 in (0.864 mm) inside diameter and a 0.063 in (1.60 mm) outside diameter, and air line 472 is formed of tubing with a 0.116 in (2.95 mm) inside diameter and a 0.156 in (3.96 mm) outside diameter. Apertures 479 are 0.014 in (0.356 mm) in diameter, and apertures 481 are 0.040 in (1.02 mm) in diameter. Other parts are sized accordingly.

Figure 18:
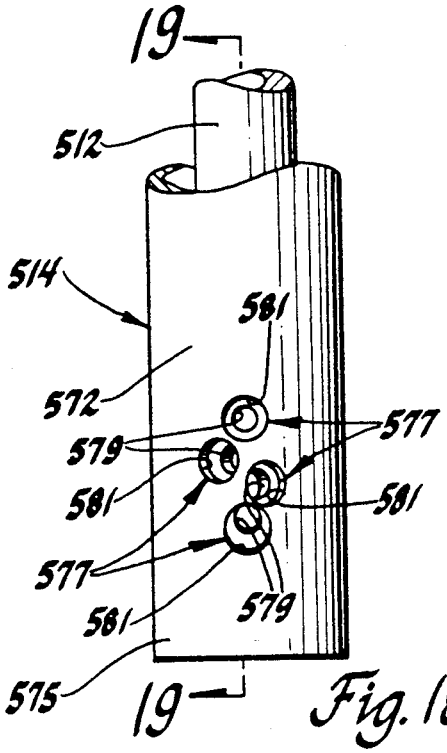
FIG. 18 is an enlarged view of another tip for the FIG. 14 injection nozzles.
Figure 19:
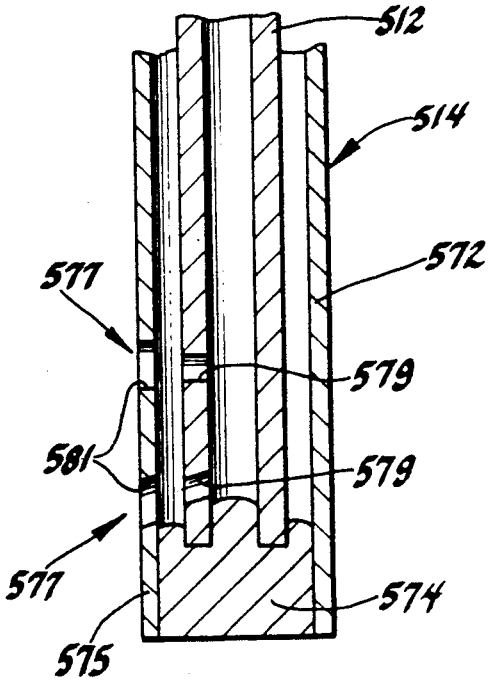
FIG. 19 is a sectional view of the FIG. 18 tip, taken along line 19—19 of FIG. 18.

Referring to the injection nozzle of FIGS. 18 and 19, fuel discharge line 512 and air line 572 terminate in injection nozzle 514. The end 575 of nozzle 514 is closed by an insert 574, and the nozzle has four lateral apertures 577 to deliver the fuel and air into the stream of air flowing through the inlet manifold runner. Each aperture 577 includes a small aperture 579 opening from fuel discharge line 512 into air line 572 and a larger aperture 581 opening from air line 572.

In the particular application for which this embodiment of the invention was developed, fuel discharge line 512 is formed of tubing with a 0.028 in (0.711 mm) inside diameter and a 0.063 in (1.60 mm) outside diameter, and air line 572 is formed of tubing with a 0.093 in (2.36 mm) inside diameter and a 0.118 in (3.00 mm) outside diameter. Apertures 579 are 0.014 in (0.356 mm) in diameter, and apertures 581 are 0.025 in (0.635 mm) in diameter.

Referring to the system of FIGS. 20 through 22, a single injector 610 receives fuel from a source of fuel at a desired pressure and meters fuel into six fuel discharge lines 612. Each line 612 leads to an injection nozzle 614 that delivers the metered fuel into the stream of air flowing through one of the inlet manifold runners 616 and one of the combustion chamber inlet ports 618 to one of the combustion chambers 620 of a six cylinder engine 621.

Injector 610 has a housing 622 with a fuel inlet port 624 and an excess fuel outlet port 626 that establish a path for fuel flow through housing 622. Housing 622 is secured to an injector base 628. A solenoid operated valve member 630 controls fuel flow from housing 622 through an annular region 632 of base 628 to six fuel discharge passages 646 that extend to fuel discharge lines 612.

Annular region 632 includes a valve surface 648. A spring 650 biases valve member 630 into engagement with valve surface 648 to interrupt fuel flow through annular region 632. When energized, a solenoid coil 652 lifts valve member 630 against the bias of spring 650 to permit fuel flow through annular region 632 to fuel discharge passages 634 and lines 612.

To reduce the motion of valve member 630 as it is lifted by solenoid coil 652, valve member 630 has an aperture 654 opening from housing 622 to the center of annular region 632. Thus when valve member 630 is lifted by coil 652, fuel flows into annular region 632 both around valve member 630 and through aperture 654. It will be understood, therefore, that the clearance required between valve member 630 and valve surface 648 is less with aperture 654 providing a path for fuel flow between valve member 630 and valve surface 648 into annular region 632 than would be required if it were necessary for all fuel flow into annular region 632 to pass around valve member 630 and between valve member 630 and valve surface 648.

Injector 610 is in other respects similar to injector 10, and further details of construction are set forth in U.S. Pat. No. 4,572,436 and will not be repeated here.

Each fuel discharge line 612 terminates in an orifice 679 in an injection nozzle 614. Each nozzle 614 has an air line 672 opening from the atmosphere and terminating in an orifice 681. Nozzles 614 deliver the fuel and air into the stream of air flowing through the inlet ports 618.

In operation, the atmospheric pressure induces air to flow through air lines 672 to the subatmospheric pressure in the inlet ports 618. When solenoid coil 652 is energized, fuel flows through annular region 632 to fuel discharge passages 634 and lines 612.

Air flow through air lines 672 provides a source of air at substantially atmospheric pressure at the tip of nozzles 614 where the fuel is introduced into the stream of air flowing through the inlet ports 618.

Referring to the injection nozzle of FIG. 23, fuel discharge line 712 and air line 772 terminate in injection nozzle 714. To form nozzle 714, the open end 775 of each air line 772 is reduced, and the open end of each fuel line 712 is spaced from the end 775 of the associated air line 772.

Each fuel line 712 is formed with a helically coiled section 783 that embraces the inner wall 785 of the associated air line 772 to support the fuel line 712 within the air line 772.

In the particular application for which this embodiment of the invention was developed, fuel discharge line 712 is formed of tubing with a 0.034 in (0.864 mm) inside diameter and a 0.062 in (1.57 mm) outside diameter, air line 772 is formed of tubing with a 0.120 in (3.05 mm) inside diameter and a 0.156 in (3.96 mm) outside diameter, and the helically coiled section 783 has a free overall diameter of at least 0.125 in (3.18 mm) to assure that it will be compressively engaged with the inside wall 785 of the air line 772. The end 775 of each air line 772 is reduced to an inside diameter of 0.055 in (1.4 mm) over a length of 0.04 in (1.02 mm), and the spacing between the end of the fuel line 712 and the end 775 of the air line 772 is adjusted for the desired fuel spray characteristic.

Figure 2:
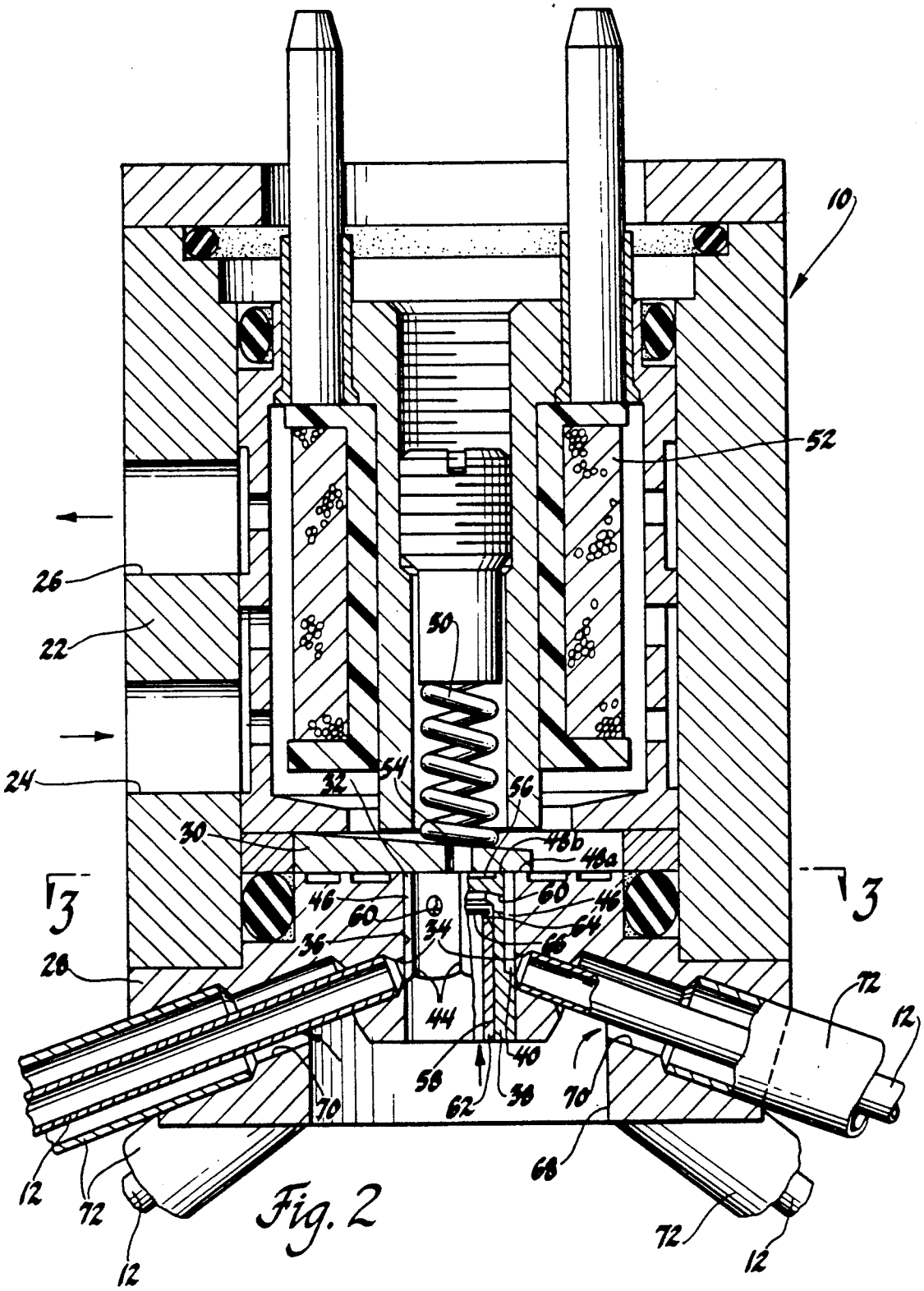
FIG. 2 is an enlarged sectional view of the FIG. 1 injector, showing a solenoid operated valve member that meters fuel through sectors of a cylindrical fuel distribution chamber to fuel discharge passages and lines that lead to the injection nozzles, a rectifier valve disc that admits air through the fuel distribution chamber sectors to the fuel discharge passages and lines, and an air inlet for air lines that surround the fuel discharge lines.
Figure 3:
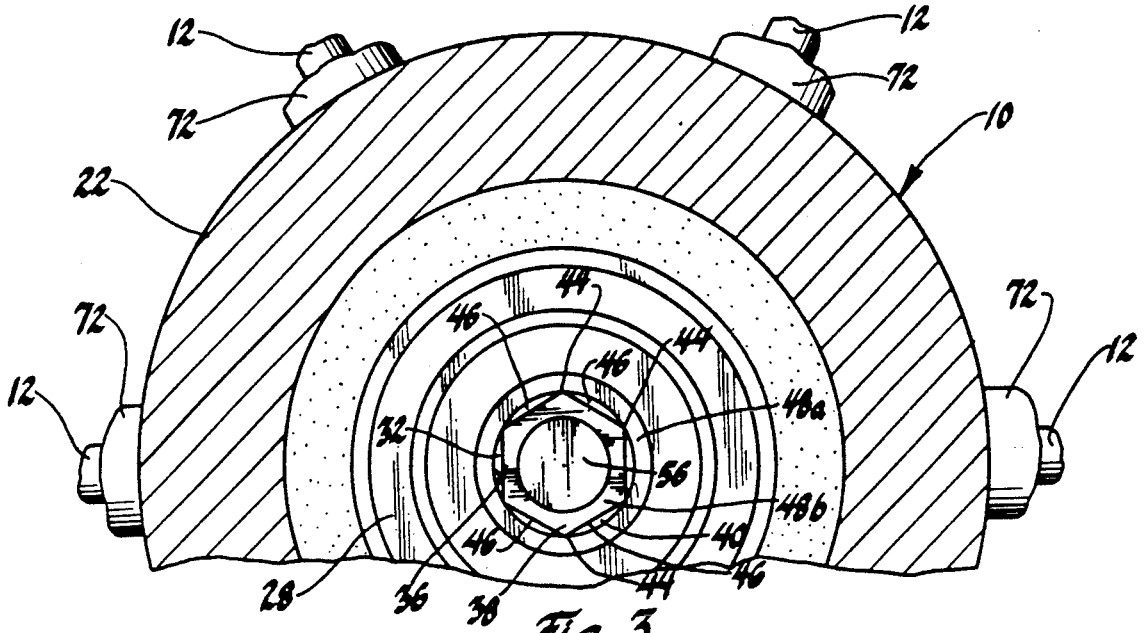
FIG. 3 is a view, indicated by the line 3—3 of FIG. 2, of the fuel inlet side of the base of the FIG. 2 injector.
Figure 4:
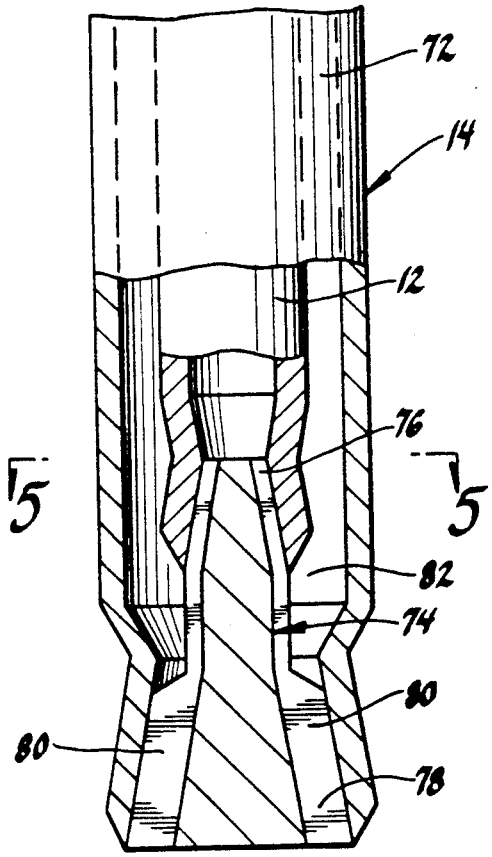
FIG. 4 is an enlarged sectional view of the tip of the FIG. 1 injection nozzles.
Figure 5:
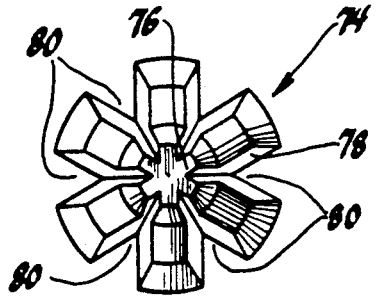
FIG. 5 is a view, indicated by the line 5—5 of FIG. 4, of an insert for the FIG. 1 injection nozzles, showing the insert before its installation in the nozzle.
Figure 6:
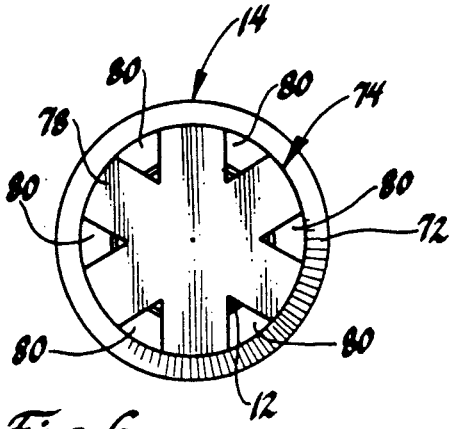
FIG. 6 is an enlarged end view of the FIG. 1 injection nozzles.

Nozzles 714 may be employed to directly replace nozzles 14 in the FIG. 1 embodiment. In another embodiment, however, the injector shown in FIG. 2 is mounted in the top of an inlet manifold plenum with the terminals for the solenoid coil projecting outside and the concentric fuel and air lines extending inside the manifold through the manifold plenum and runners to nozzles 714. Such a construction presents an improved appearance and protects the concentric fuel and air lines against damage, while still allowing nozzles 714 to deliver metered fuel into the stream of air flowing through the combustion chamber inlet ports to the engine combustion chambers. In such a construction, of course, an air supply line must extend from a source of clean air to the base of the injector.

The embodiments of the invention in which an exclusive property or privilege is claimed are defined as follows.

1. A fuel injector for metering fuel to a plurality of fuel injection nozzles, said fuel injector comprising a housing and further comprising a base having a central bore, said base including a plug received in said bore and defining a fuel distribution chamber between said plug and said bore, said base also having a plurality of discharge passages opening from said distribution chamber, each of said discharge passages being adapted to direct fuel to one of said nozzles, said base having an annular valve surface through which fuel may be delivered directly from said housing to said fuel distribution chamber, said annular valve surface including a first portion surrounding said bore and a second portion at the perimeter of said plug, a single valve member associated with said valve surface, said valve member being adapted to engage said valve surface to preclude fuel delivery into said distribution chamber, and a solenoid adapted to disengage said valve member from said valve surface to permit fuel delivery to said distribution chamber and thereby to said discharge passages.

2. A fuel injector for metering fuel to a plurality of fuel injection nozzles, said fuel injector comprising a base having a central bore, said base including a plug received in said bore and defining a fuel distribution chamber between said plug and said bore, said plug engaging said bore at peripherally spaced locations to divide said distribution chamber into a plurality of sectors, said base also having a plurality of discharge passages each opening from one of said distribution chamber sectors, each of said discharge passages being adapted to direct fuel to one of said nozzles, said base having an annular valve surface including a first portion surrounding said bore and a second portion at the perimeter of said plug, a single valve member associated with said valve surface, said valve member being adapted to engage said valve surface to preclude fuel delivery into said distribution chamber, and a solenoid adapted to disengage said valve member from said valve surface to permit fuel delivery to said distribution chamber and thereby to said discharge passages.

3. A fuel injector for metering fuel to a plurality of fuel injection nozzles, said fuel injector comprising a base having a plurality of discharge passages and a region through which fuel is delivered to said discharge passages, each of said discharge passages being adapted to direct fuel to one of said nozzles, said region including a valve surface, a single valve member associated with said valve surface, said valve member being adapted to engage said valve surface to preclude fuel delivery to said discharge passages, a solenoid adapted to disengage said valve member from said valve surface to permit fuel delivery to said discharge passages, said base also having an opening through which air flows to said discharge passages, a valve seat surrounding said opening, and a rectifier valve associated with said valve seat, said rectifier valve being pressure responsive and thereby being adapted to engage said valve seat to preclude flow through said opening when said valve member permits fuel delivery to said discharge passages and to disengage said valve seat to admit air to said discharge passages when said valve member precludes fuel delivery to said discharge passages.

4. A fuel injector for metering fuel to a plurality of fuel injection nozzles, said fuel injector comprising a base having a plurality of discharge passages and an annular region through which fuel is delivered to said discharge passages, each of said discharge passages being adapted to direct fuel to one of said nozzles, said annular region including a valve surface, a single valve member associated with said valve surface, said valve member being adapted to engage said valve surface to preclude fuel delivery to said discharge passages, a solenoid adapted to disengage said valve member from said valve surface to permit fuel delivery to said discharge passages, said base also having an opening through which air flows to said discharge passages, a valve seat surrounding said opening, and a rectifier valve disc associated with said valve seat, said rectifier valve disc being pressure responsive and thereby being adapted to engage said valve seat to preclude flow through said opening when said valve member permits fuel delivery to said discharge passages and to disengage said valve seat to admit air to said discharge passages when said valve member precludes fuel delivery to said discharge passages.

5. A fuel injector for metering fuel to a plurality of fuel injection nozzles, said fuel injector comprising a base having a central bore, said base including a plug received in said bore and defining a fuel distribution chamber between said plug and said bore, said base also having a plurality of discharge passages opening from said distribution chamber, each of said discharge passages being adapted to direct fuel to one of said nozzles, said base having an annular valve surface including a first portion surrounding said bore and a second portion at the perimeter of said plug, a single valve member associated with said valve surface, said valve member being adapted to engage said valve surface to preclude fuel delivery into said distribution chamber, a solenoid adapted to disengage said valve member from said valve surface to permit fuel delivery to said distribution chamber and thereby to said discharge passages, said base also having an opening through which air flows to said distribution chamber, a valve seat surrounding said opening, and a rectifier valve disc associated with said valve seat, said rectifier valve disc being pressure responsive and thereby being adapted to engage said valve seat to preclude flow through said opening when said valve member permits fuel delivery to said distribution chamber and to disengage said valve seat to admit air to said distribution chamber when said valve member precludes fuel delivery to said distribution chamber.

6. A fuel injector for metering fuel to a plurality of fuel injection nozzles, said fuel injector comprising a base having a central bore, said base including a plug received in said bore and defining a fuel distribution chamber between said plug and said bore, said plug engaging said bore at peripherally spaced locations to divide said distribution chamber into a plurality of sectors, said base also having a plurality of discharge passages each opening from one of said distribution chamber sectors, each of said discharge passages being adapted to direct fuel to one of said nozzles, said base having an annular valve surface including a first portion surrounding said bore and a second portion at the perimeter of said plug, a single valve member associated with said valve surface, said valve member being adapted to engage said valve surface to preclude fuel delivery into said distribution chamber sectors, a solenoid adapted to disengage said valve member from said valve surface to permit fuel delivery to said distribution chamber sectors and thereby to said discharge passages, said base also having an opening through which air flows to said distribution chamber sectors, a valve seat surrounding said opening, and a rectifier valve disc associated with said valve seat, said rectifier valve disc being pressure responsive and thereby being adapted to engage said valve seat to preclude flow through said opening when said valve member permits fuel delivery to said distribution chamber sectors and to disengage said valve seat to admit air to said distribution chamber sectors when said valve member precludes fuel delivery to said distribution chamber sectors.

7. A fuel injection system for injecting fuel through a plurality of fuel injection nozzles, said system comprising a fuel injector having a base with a plurality of discharge passages and an inlet to said discharge passages, said inlet including a valve surface, a valve member associated with said valve surface, said valve member being adapted to engage said valve surface to preclude fuel delivery through said inlet to said discharge passages, a solenoid adapted to disengage said valve member from said valve surface to permit fuel delivery through said inlet to said discharge passages, a plurality of fuel discharge lines respectively connected at one end to said discharge passages and extending to said nozzles at the other end, said base further having an air inlet surrounding said one end of each of said fuel discharge lines, and a plurality of air lines connected at one end to said air inlet and respectively surrounding said fuel discharge lines and extending to said nozzles at the other end.

8. A fuel injector for metering fuel to a plurality of fuel injection nozzles, said fuel injector comprising a base having a plurality of discharge passages and an annular region through which fuel is delivered to said discharge passages, each of said discharge passages being adapted to direct fuel to one of said nozzles, said base further having means defining an inlet to said annular region, said inlet including a valve surface, a valve member associated with said valve surface, said valve member being adapted to engage said valve surface to preclude fuel delivery through said inlet to said discharge passages, a solenoid adapted to disengage said valve member from said valve surface to permit fuel delivery through said inlet to said discharge passages, said base also having an opening through which air flows to said discharge passages, said annular region including a valve surface, and a diaphragm valve overlying said valve surface, said diaphragm valve being pressure responsive and thereby being adapted to engage said valve surface to preclude flow through said opening when said valve member permits fuel delivery to said discharge passages and to disengage said valve surface to admit air to said discharge passages when said valve member precludes fuel delivery to said discharge passages.

9. A fuel injector for metering fuel to a plurality of fuel injection nozzles, said fuel injector comprising a base having an annular valve surface and a plurality of discharge passages each opening directly through said valve surface, each of said discharge passages being adapted to direct fuel to one of said nozzles, a single valve member associated with said valve surface, said valve member being adapted to engage said valve surface to preclude fuel delivery to said discharge passages, and a solenoid adapted to disengage said valve member from said valve surface to permit fuel delivery to said discharge passages.

10. A fuel injector for metering fuel to a plurality of fuel injection nozzles, said fuel injector comprising a base having a a plurality of discharge passages and an annular region through which fuel is delivered to said discharge passages, each of said discharge passages being adapted to direct fuel to one of said nozzles, said annular region including a valve surface, a single valve member associated with said valve surface, said valve member being adapted to engage said valve surface to preclude fuel delivery to said discharge passages, a solenoid adapted to disengage said valve member from said valve surface to permit fuel delivery to said discharge passages, said base also having an additional annular region through which air flows to said discharge passages, said additional annular region including an additional valve surface, an additional single valve member associated with said additional valve surface, said additional valve member being adapted to engage said additional valve surface to preclude air flow to said discharge passages, and an additional solenoid adapted to disengage said additional valve member from said additional valve surface to permit air flow to said discharge passages.

11. A fuel injector for metering fuel to a plurality of fuel injection nozzles, said fuel injector comprising a base having an annular valve surface and a plurality of discharge passages, each of said passages including a first portion opening through said valve surface, each of said discharge passages including a second portion extending at an angle to said first portion and being adapted to direct fuel to one of said nozzles, a single valve member associated with said valve surface, said valve member being adapted to engage said valve surface to preclude fuel delivery to said discharge passages, a solenoid adapted to disengage said valve member from said valve surface to permit fuel delivery to said discharge passages, said base also having an opening through which air flows to said discharge passages, a valve seat surrounding said opening, and a rectifier valve disc associated with said valve seat, said rectifier valve disc being pressure responsive and thereby being adapted to engage said valve seat to preclude flow through said opening when said valve member permits fuel delivery to said discharge passages and to disengage save valve seat to admit air to said discharge passages when said valve member precludes fuel delivery to said discharge passages.

* * * * *